US006809687B2

(12) United States Patent
Yuanzhu

(10) Patent No.: US 6,809,687 B2
(45) Date of Patent: Oct. 26, 2004

(54) MONOPOLE ANTENNA THAT CAN EASILY BE REDUCED IN HEIGHT DIMENSION

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/278,676

(22) Filed: Oct. 23, 2002

(65) Prior Publication Data

US 2003/0076264 A1 Apr. 24, 2003

(30) Foreign Application Priority Data

Oct. 24, 2001 (JP) ..... 2001-326551
Oct. 24, 2001 (JP) ..... 2001-326554
Oct. 24, 2001 (JP) ..... 2001-326582
Oct. 24, 2001 (JP) ..... 2001-326587
Nov. 7, 2001 (JP) ..... 2001-342315

(51) Int. Cl.[7] ..... H01Q 1/38
(52) U.S. Cl. ..... 343/700 MS; 343/702; 343/846
(58) Field of Search ..... 343/700 MS, 702, 343/846, 848, 828

(56) References Cited

U.S. PATENT DOCUMENTS 5,828,340 A * 10/1998 Johnson ..... 343/700 MS
5,847,682 A * 12/1998 Ke ..... 343/752
6,008,773 A * 12/1999 Matsuoka et al. ..... 343/818
6,157,344 A * 12/2000 Bateman et al. ..... 343/700 MS
6,476,767 B2 * 11/2002 Aoyama et al. ..... 343/700 MS
6,515,626 B2 * 2/2003 Bark et al. ..... 343/700 MS
6,518,937 B2 * 2/2003 Fang ..... 343/895
6,525,691 B2 * 2/2003 Varadan et al. ..... 343/700 MS
6,563,469 B2 * 5/2003 Miyata et al. ..... 343/743
6,573,866 B2 * 6/2003 Chen ..... 343/700 MS
2003/0063033 A1 * 4/2003 Purr et al. ..... 343/700 MS

FOREIGN PATENT DOCUMENTS

JP 11-298232 10/1999

* cited by examiner

*Primary Examiner*—Tan Ho
(74) *Attorney, Agent, or Firm*—Brinks Hofer Gilson & Lione

(57) ABSTRACT

There are provided a dielectric substrate that erects from a ground surface, and a radiation conductor that is provided on a surface of the dielectric substrate so as to extend in the vertical direction. The bottom end of the radiation conductor is connected to a feeder line. The radiation conductor has a bottom portion and a top portion that is distant from the ground surface and is wider than the bottom portion. Increasing the capacitance by making wide the top portion (capacitive region), having a large voltage variation, of the radiation conductor in this manner lowers the resonance frequency. Therefore, a height dimension of the radiation conductor for attaining resonance at a desired frequency can be made much smaller than in conventional monopole antennas.

25 Claims, 12 Drawing Sheets

MONOPOLE ANTENNA THAT CAN EASILY BE REDUCED IN HEIGHT DIMENSION

BACKGROUND OF THE INVENTION

1. Field of the Invention

The present invention relates to a monopole antenna that is used for transmission and reception of satellite communication and satellite broadcast. In particular, the invention relates to a monopole antenna that is suitable for vehicular and portable use.

2. Description of the Related Art

A rod-shaped radiation conductor that erects from a ground surface of a metal plate or the like and that has an overall length of $\lambda/4$ ($\lambda$: the free space wavelength of radio waves) is widely employed as a monopole antenna that is used in mobile communication equipment etc. for transmission and reception of radio waves in a frequency range of 800–2,000 MHz. In such a monopole antenna, a feeder line such as a coaxial cable is connected to the bottom end of the radiation conductor that extends in the vertical direction. The length of the radiation conductor is so set that the radiation conductor resonates with radio waves having a desired frequency.

In vehicular telephones etc., a dual-band monopole antenna that can be used for transmission and reception of both of radio waves of an 800-MHz frequency band and radio waves of 1.9-GHz frequency band, for example, is required. Conventionally, two rod-shaped radiation conductors that erect from a ground surface of a metal plate or the like and that extend in the vertical direction are widely employed in this kind of dual-band monopole antenna. Since the overall length of each of the two radiation conductors is set to $\lambda/4$ ($\lambda$: the free space wavelength of corresponding radio waves), one rod-shaped radiation conductor for transmission and reception of radio waves of a lower frequency band is long and the other rod-shaped radiation conductor for transmission and reception of radio waves of a higher frequency band is short. Feeder lines such as coaxial cables are connected to the bottom ends of the two rod-shaped radiation conductors, respectively, whereby signals having different frequencies are supplied to the respective radiation conductors.

However, in the above-described conventional monopole antenna, the overall length of the rod-shaped radiation conductor is equal to $\lambda/4$. Therefore, to transmit and receive radio waves of the 800-MHz band which is frequently used for cellular phones, for example, a radiation conductor whose overall length almost amounts to 10 cm is necessary. This means a problem that the height dimension is too large for use as a vehicular monopole antenna. In addition, this kind of monopole antenna has a narrow resonance frequency band, that is, it resonates with only radio waves whose frequency is close to a particular frequency. This raises fear that the sensitivity may decrease extremely when ratio waves to be received are deviated in frequency.

In view of the above, recently, a monopole antenna has been proposed that is reduced in height dimension by forming a band-shaped radiation conductor having a constant width on the surface of a dielectric substrate made of ceramics or the like by printing, etching, or a like method. According to this conventional technique, the overall length of the radiation conductor can be reduced by about 20% by virtue of the wavelength shortening by the dielectric. However, where the height dimension is restricted severely as in the case of monopole antennas for vehicular use, it is desired that the radiation conductor be shortened further.

SUMMARY OF THE INVENTION

The present invention has been made in view of the above circumstances in the art, and an object of the invention is therefore to provide a monopole antenna that can easily be reduced in height dimension and hence can accelerate miniaturization.

To attain the above object, a first aspect of the invention provides a monopole antenna comprising a dielectric substrate that erects from a ground surface; and a radiation conductor that is provided on a surface of the dielectric substrate so as to extend in the vertical direction, a bottom end of the radiation conductor being connected to a feeder line, the radiation conductor having a bottom portion and a top portion that is distant from the ground surface and is wider than the bottom portion.

In the monopole antenna having the above configuration, since the top portion (capacitive region), having a large voltage variation, of the radiation conductor is wide, the capacitance is increased. In general, the resonance frequency of a resonance circuit lowers as its capacitance increases. Therefore, if the length of the radiation conductor is equivalent, the resonance frequency of this monopole antenna is lower than that of a monopole antenna in which a band-shaped radiation conductor not having a wide top portion is formed on the surface of a dielectric substrate. That is, providing the wide portion as the top portion makes it possible to set short a length of the radiation conductor that is necessary to attain resonance at a desired frequency and hence to reduce the height dimension of the entire monopole antenna easily.

In the above configuration, the dielectric substrate may be formed with through-holes or thin portions in a bottom region. In this case, the inductance increases because the dielectric constant decreases around the bottom portion (inductive region) of the radiation conductor. In general, the resonance frequency of a resonance circuit lowers as its inductance increases. Therefore, in this case, a length of the radiation conductor that is necessary to attain resonance at a desired frequency can be set shorter and hence the height dimension of the entire monopole antenna can further be reduced. A ground electrode may be provided on the dielectric substrate in a bottom end region and soldered to the ground surface. This makes it unnecessary to screw the dielectric substrate to the ground surface, which makes work of connecting the monopole antenna to a feeder line such as a coaxial cable easier.

A second aspect of the invention provides a monopole antenna comprising a dielectric substrate that erects from a ground surface; a first radiation conductor that is provided on a surface of the dielectric substrate so as to extend in the vertical direction, a bottom end of the first radiation conductor being connected to a feeder line; and a second radiation conductor that extends parallel with a plane that is approximately perpendicular to the dielectric substrate, the second radiation conductor being connected to a top end of the first radiation conductor.

In the monopole antenna having the above configuration, a maximum voltage variation occurs in the second radiation conductor which is connected to the top end of the first radiation conductor. Since the second radiation conductor is extended to a plane that is approximately perpendicular to the dielectric substrate, the capacitance is large there. In general, the resonance frequency of a resonance circuit lowers as its capacitance increases. Therefore, if the overall height dimension is equivalent, the resonance frequency of this monopole antenna is lower than that of a conventional one in which only a band-shaped radiation conductor having a constant width is formed on the surface of a dielectric substrate. Therefore, in this monopole antenna, an overall height dimension for attaining resonance at a desired frequency can be made shorter than in such a conventional monopole antenna.

In the above configuration, the second radiation conductor may be a metal plate. Alternatively, a small dielectric substrate may be provided on the dielectric substrate so as to be approximately perpendicular to the dielectric substrate, and the second radiation conductor may be provided on one or both surfaces of the small dielectric substrate. In this case, in manufacture, the first and second radiation conductors can be formed together on the surfaces of the dielectric substrate and the small dielectric substrate that are formed from a common substrate, which is suitable for mass-production. In addition, the resonance frequency can further be lowered by utilizing the wavelength shortening effect of the small dielectric substrate.

In each of the above configurations according to the second aspect of the invention, the first radiation conductor may have a bottom portion and a top portion (capacitive region) that is distant from the ground surface and is wider than the bottom portion. In this case, the capacitance of the first radiation conductor increases and hence the resonance frequency further lowers. Therefore, the height dimension of the entire monopole antenna can further be reduced.

In each of the above configurations according to the second aspect of the invention, the dielectric substrate may be formed with through-holes or thin portions in a bottom region. In this case, the inductance increases because the dielectric constant decreases around the bottom portion (inductive region) of the radiation conductor. In general, the resonance frequency of a resonance circuit lowers as its inductance increases. Therefore, in this case, a length of the radiation conductor that is necessary to attain resonance at a desired frequency can be set shorter and hence the height dimension of the entire monopole antenna can further be reduced. A ground electrode may be provided on the dielectric substrate in a bottom end region and soldered to the ground surface. This makes it unnecessary to screw the dielectric substrate to the ground surface, which makes work of connecting the monopole antenna to a feeder line such as a coaxial cable easier.

A third aspect of the invention provides a monopole antenna comprising a dielectric substrate that erects from a ground surface; a first radiation conductor that is provided on a surface of the dielectric substrate so as to extend in the vertical direction and that has a feeding point at a bottom end; and a second radiation conductor that is provided on a surface of the dielectric substrate so as to have approximately the same shape as the first radiation conductor and to have a parallel positional relationship with the first radiation conductor, and that has a feeding point at a bottom end, wherein the first and second radiation conductors have different lengths and signals having the same frequency are supplied to the feeding points of the first and second radiation conductors, respectively.

In the monopole antenna having the above configuration, by coupling appropriately together the first radiation conductor and the second radiation conductor that are slightly different from each other in length by using a capacitor or the like, the monopole antenna can resonate with both of radio waves whose wavelength corresponds to the length of the first radiation conductor and radio waves whose wavelength corresponds to the length of the second radiation conductor, whereby the resonance frequency band can be widened to a large extent. Since the first and second radiation conductors are formed on the surface of the dielectric substrate made of ceramics or the like, the length of each radiation conductor can be set with an additional effect of wavelength shortening by the dielectric. Therefore, the height dimension of the monopole antenna can easily be reduced.

In the above configuration, the first radiation conductor may be provided on one surface of the dielectric substrate and the second radiation conductor may be provided on the opposite surface of the dielectric substrate. This allows each radiation conductor to be designed easily so as to have a desired shape. For example, each of the first and second radiation conductors may be so designed as to have a wide top portion (capacitive region) that is distant from the ground surface so that the capacitance of each radiation conductor is increased. Since the resonance frequency lowers accordingly, a length (height dimension) of each radiation conductor that is necessary to attain resonance at a desired frequency can further be reduced.

There may be provided a third radiation conductor that is provided on the dielectric substrate so as to extend parallel with a plane that is approximately perpendicular to the dielectric substrate, the third radiation conductor being connected to the top end of the first radiation conductor; and a fourth radiation conductor that is provided on the dielectric substrate so as to extend parallel with a plane that is approximately perpendicular to the dielectric substrate, the fourth radiation conductor being connected to the top end of the second radiation conductor. With this structure, the capacitance of the first and third radiation conductors as an integrated radiation conductor and the capacitance of the second and fourth radiation conductors as another integrated radiation conductor are large, whereby the resonance frequency can be lowered and the height dimension can be reduced. In this case, a small dielectric substrate may be provided on the dielectric substrate so as to be approximately perpendicular to the dielectric substrate, and the third and fourth radiation conductors may be provided on a surface of the small dielectric substrate. This makes it possible to further reduce the height dimension by utilizing the wavelength shortening effect of the small dielectric substrate.

A fourth aspect of the invention provides a monopole antenna comprising a dielectric substrate that erects from a ground surface; a first radiation conductor that is provided on a surface of the dielectric substrate so as to extend in the vertical direction and to have a wide top portion; and a second radiation conductor that is provided on the surface of the dielectric substrate so as to extend in the vertical direction and to have a smaller length dimension than the first radiation conductor, wherein a first high-frequency signal is supplied to the first radiation conductor via a feeding point that is provided at a bottom end of the first radiation conductor and a second high-frequency signal having a higher frequency than the first high-frequency signal is supplied to the second radiation conductor via a feeding point that is provided at a bottom end of the second radiation conductor.

In the above dual-band monopole antenna, the first radiation conductor needs to be longer than the second radiation conductor because the former is lower in resonance frequency than the latter. The first radiation conductor has a large capacitance because the wide portion is formed as the top portion (capacitive region) that is distant from the ground surface. In general, the resonance frequency of a resonance circuit lowers as its capacitance increases. This monopole antenna is also given the wavelength shortening effect of the dielectric substrate. Consequently, a length of the first radiation conductor that is necessary to attain resonance at a desired frequency (of the first high-frequency signal) can be reduced to a large extent and the reduction of the height dimension of the entire monopole antenna can be accelerated. In this case, a third radiation conductor that has approximately the same shape as and a different length dimension in the vertical direction than the first radiation conductor that is provided on one surface of the dielectric substrate may be provided on the opposite surface of the dielectric substrate, and the first high-frequency signal may be supplied to the bottom end of the third radiation conductor. The resonance frequency band can be widened by coupling appropriately the first and third radiation conductors to each other by using a capacitor or the like.

The fourth aspect of the invention also provides a monopole antenna in which the first radiation conductor has an erect portion that is provided on a surface of the dielectric substrate so as to extend in the vertical direction and a horizontal portion that is provided on the dielectric substrate so as to extend horizontally and is connected to the top end of the erect portion. Also in this case, the first radiation conductor has a large capacitance. Therefore, a length of the first radiation conductor that is necessary to attain resonance at a desired frequency can be reduced. In this case, a small dielectric substrate may be provided on the dielectric substrate so as to be approximately perpendicular to the dielectric substrate, and the horizontal portion of the first radiation conductor may be provided on a surface of the small dielectric substrate. This makes it possible to further reduce the height dimension by virtue of the wavelength shortening effect of the small dielectric substrate. In this configuration, the erect portion of the first radiation conductor may have a wide top portion. This further increases the capacitance, whereby the resonance frequency can further be lowered and the reduction of the height dimension can be accelerated.

In each of the configurations according to the fourth aspect of the invention, a fourth radiation conductor that has approximately the same shape as and a different length dimension in the vertical direction than the second radiation conductor that is provided on one surface of the dielectric substrate may be provided on the opposite surface of the dielectric substrate, and the second high-frequency signal may be supplied to the bottom end of the fourth radiation conductor. The resonance frequency band can be widened by coupling appropriately the second and fourth radiation conductors to each other by using a capacitor or the like.

A branching circuit that passes signals having particular frequencies may be incorporated so that a signal having a lower frequency is supplied via a coil and a signal having a higher frequency is supplied via a capacitor. This enables common use of an input voltage source. That is, the circuit configuration can be simplified by supplying the first high-frequency signal to the first radiation conductor and the second high-frequency signal to the second radiation conductor from a common input voltage source via the coil and the capacitor, respectively.

A fifth aspect of the invention provides a monopole antenna comprising a dielectric substrate that erects from a ground conductor; and a radiation conductor that is provided on a surface of the dielectric substrate, a bottom end of the radiation conductor being connected to a feeder line, the radiation conductor having a zigzagged band-shaped portion that extends in the vertical direction as a whole while its actual extension direction varies successively or continuously. It is preferable that the zigzagged band-shaped portion be shaped in such a manner that its actual extension direction varies in one of a crank form, a saw-tooth form, and a wave form.

Providing the radiation conductor with the zigzagged band-shaped portion makes it possible to increase its length without changing its height, which enables resonance with radio waves having a longer wavelength, that is, lowers the resonance frequency. Therefore, a height of the radiation conductor that is necessary to attain resonance at a desired frequency can be reduced. Also with the wavelength shortening effect of the dielectric substrate, the height dimension of the monopole antenna can be reduced to a large extent.

In the above configuration, the radiation conductor may have, as a top portion (capacitive region) where a large voltage variation occurs, a wide portion that is wider than the zigzagged band-shaped portion. This can increase the capacitance. In general, the resonance frequency of a resonance circuit lowers as the capacitance increases. Therefore, in this case, a height of the radiation conductor that is necessary to attain resonance at a desired frequency can further be reduced.

Alternatively, in the above configuration, there may be provided a second radiation conductor that extends parallel with a plane that is approximately perpendicular to the dielectric substrate, the second radiation conductor being connected to the top end of the radiation conductor. This can also increase the capacitance and hence can lower the resonance frequency, which enables height reduction of the radiation conductor. In this case, a small dielectric substrate may be provided on the dielectric substrate so as to be approximately perpendicular to the dielectric substrate, and the second radiation conductor may be provided on one or both surfaces of the small dielectric substrate. The resonance frequency can further be lowered by utilizing the wavelength shortening effect of the small dielectric substrate.

DESCRIPTION OF THE PREFERRED EMBODIMENTS

Figure 1:
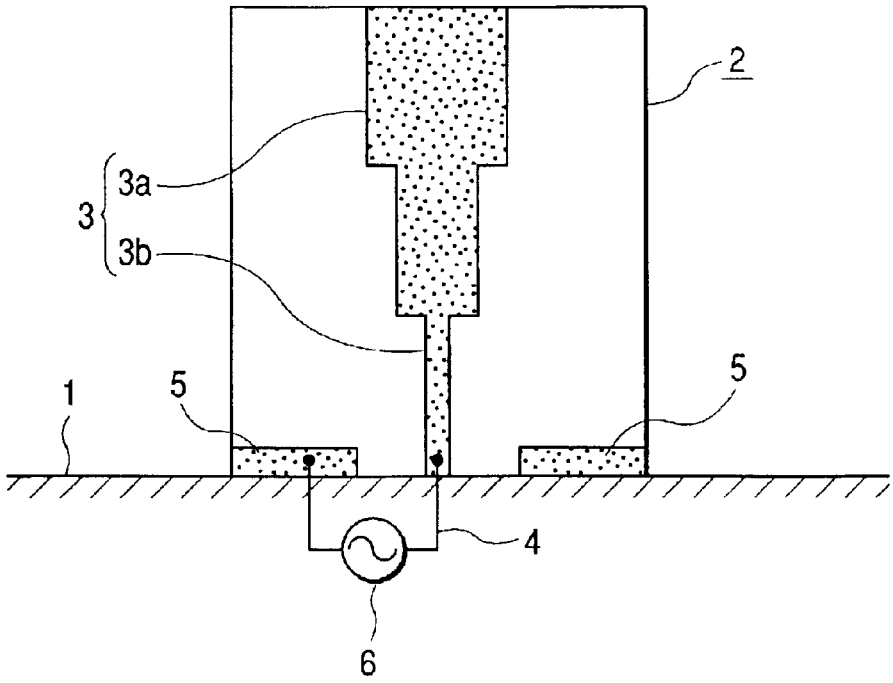
FIG. 1 is a front view of a monopole antenna according to a first embodiment of the present invention.
Figure 2:
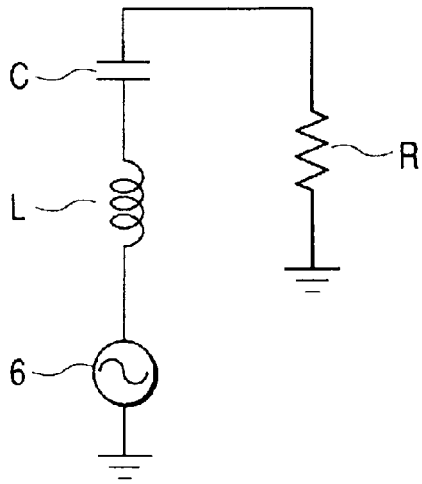
FIG. 2 is an equivalent circuit diagram of the monopole antenna of FIG. 1.

Embodiments of the present invention will be hereinafter described with reference to the drawings. FIG. 1 is a front view of a monopole antenna according to a first embodiment of the invention. FIG. 2 is an equivalent circuit diagram of the antenna of FIG. 1.

The monopole antenna of FIG. 1 is generally composed of a dielectric substrate 2 that erects from a ground surface 1 and a radiation conductor 3 that is formed on the surface of the dielectric substrate 2 so as to extend in the vertical direction. A feeder line 4 such as a coaxial cable is connected to the bottom end of the radiation conductor 3. Ground electrodes 5 are formed in a bottom end region of the dielectric substrate 2 and are soldered to the ground surface 1 of a metal plate or the like. An input voltage source 6 is connected to one of the ground electrodes 5. A high-frequency signal is supplied from the input voltage source 6 to the radiation conductor 3 via the feeder line 4.

Materials such as FR-4 that are inexpensive and have relatively large relative dielectric constants ($\in r$ is about 4.8, for example) are suitable for the dielectric substrate 2. The radiation conductor 3 and the ground electrodes 5 are patterned into desired shapes by etching copper foil that is formed on the entire surface of the dielectric substrate 2. Alternatively, the radiation conductor 3 and the ground electrodes 5 of the same shapes can be formed by printing. A top portion (approximately ⅓) of the radiation conductor 3 that is distant from the ground surface 1 is a wide portion 3*a*, and a bottom portion (approximately ⅓) of the radiation conductor 3 that is near the ground surface 1 is a narrow portion 3*b*. A portion located between the wide portion 3*a* and the narrow portion 3*b* has an intermediate width. In this embodiment, since the ground electrodes 5 in the bottom end region of the dielectric substrate 2 are soldered to the ground surface 1, it is not necessary to screw the dielectric substrate 2 on the ground surface 1 and work of connecting the monopole antenna to the feeder line 4 can be done easily.

The monopole antenna having the above structure can be represented by the equivalent circuit shown in FIG. 2. The circuit of FIG. 2 is such that a coil L and a capacitor C are connected in series to a grounded input voltage source 6 and a grounded radiation resistor R. The top portion of the radiation conductor 3 shown in FIG. 1 can be regarded as the capacitor C shown in FIG. 2 because it is in a capacitive region having a large voltage variation. Being the wide portion 3*a*, the top portion of the radiation conductor 3 has a large capacitance, which lowers the resonance frequency of the monopole antenna. The bottom portion of the radiation conductor 3 can be regarded as the coil L shown in FIG. 2 because it is in an inductive region having a large current variation. Being the narrow portion 3*b*, the bottom portion has a large inductance because it is equivalent to the coil L having a small wire diameter. This is also a factor of lowering the resonance frequency of the monopole antenna.

That is, in this embodiment, if the height dimension of the radiation conductor 3 is equivalent, the resonance frequency is lower than in a conventional monopole antenna in which a band-shaped radiation conductor having a constant width is formed on the surface of a dielectric substrate. Therefore, to attain resonance at a desired frequency, the height dimension can be made smaller than in the conventional one. Specifically, the height dimension of the radiation conductor 3 in the monopole antenna according to this embodiment can be reduced by about 15% from the conventional one in which the height dimension is reduced to 75–85% by utilizing the wavelength shortening by the dielectric.

Figure 3:
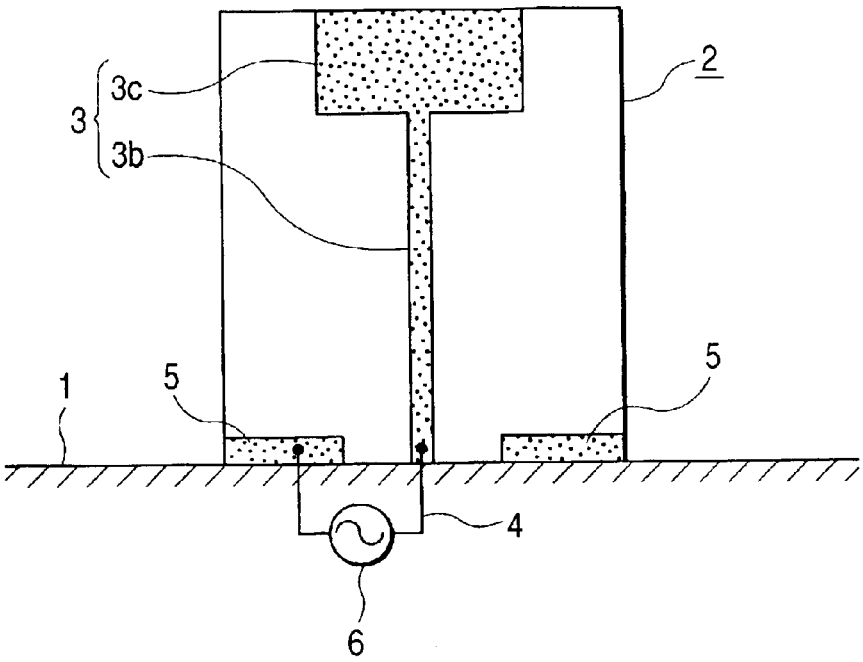
FIG. 3 is a front view of a monopole antenna according to a second embodiment of the invention.

FIG. 3 is a front view of a monopole antenna according to a second embodiment of the invention. Portions and members in FIG. 3 having counterparts in FIG. 1 are given the same reference symbols as the counterparts. In this embodiment, a top portion (about ¼) of the radiation conductor 3 is a wide portion 3*c* that is very wide. Since the capacitance is particularly large in the top portion of the radiation conductor 3 having a largest voltage variation and its vicinity, the resonance frequency is lowered to a large extent. Therefore, the height dimension of the entire monopole antenna can easily be reduced.

Figure 4:
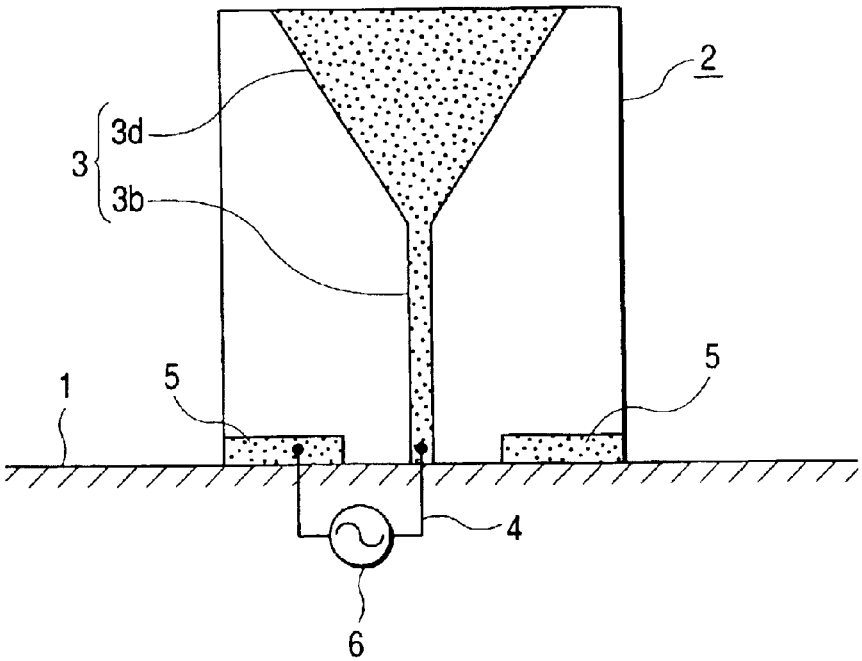
FIG. 4 is a front view of a monopole antenna according to a third embodiment of the invention.

FIG. 4 is a front view of a monopole antenna according to a third embodiment of the invention. Portions and members in FIG. 4 having counterparts in FIG. 1 or 3 are given the same reference symbols as the counterparts. In this embodiment, a lower half portion of the radiation conductor 3 is a narrow portion 3*b* and a portion above the narrow portion 3*b* is a triangular portion 3*d* whose width dimension increases gradually upward. The triangular portion 3*d* of the radiation conductor 3 that is located in a capacitive region is wide, and the width dimension is maximum at the top end of the triangular portion 3*d* having a largest voltage variation. Therefore, as in the cases of the first and second embodiments, the resonance frequency of the monopole antenna is lowered and hence the overall height dimension can be reduced.

Figure 5:
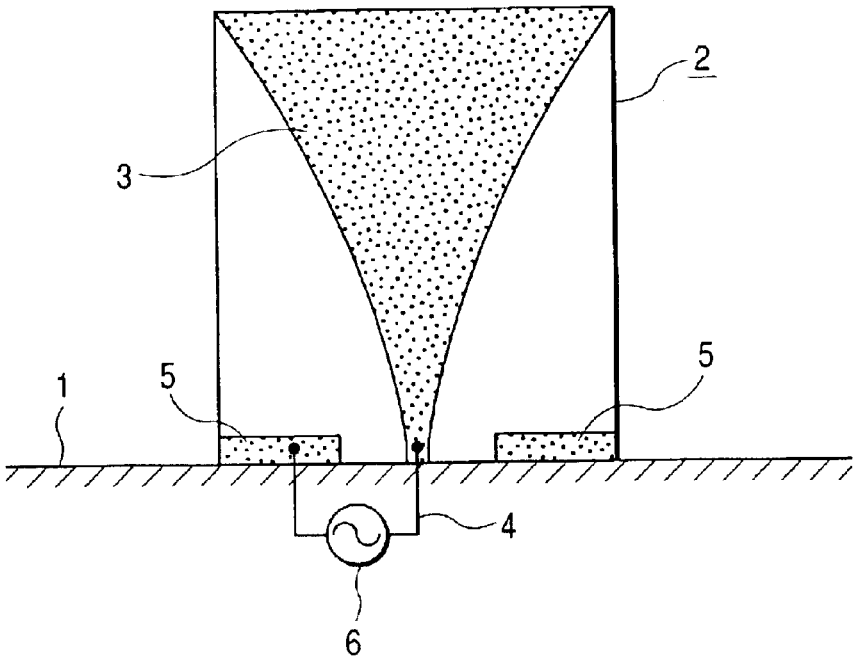
FIG. 5 is a front view of a monopole antenna according to a fourth embodiment of the invention.

FIG. 5 shows a fourth embodiment of the invention in which the radiation conductor 3 generally assumes a V-shape and its width dimension increases gradually from the bottom end to the top end. This embodiment is expected to provide the same advantages as in the third embodiment.

Figure 6:
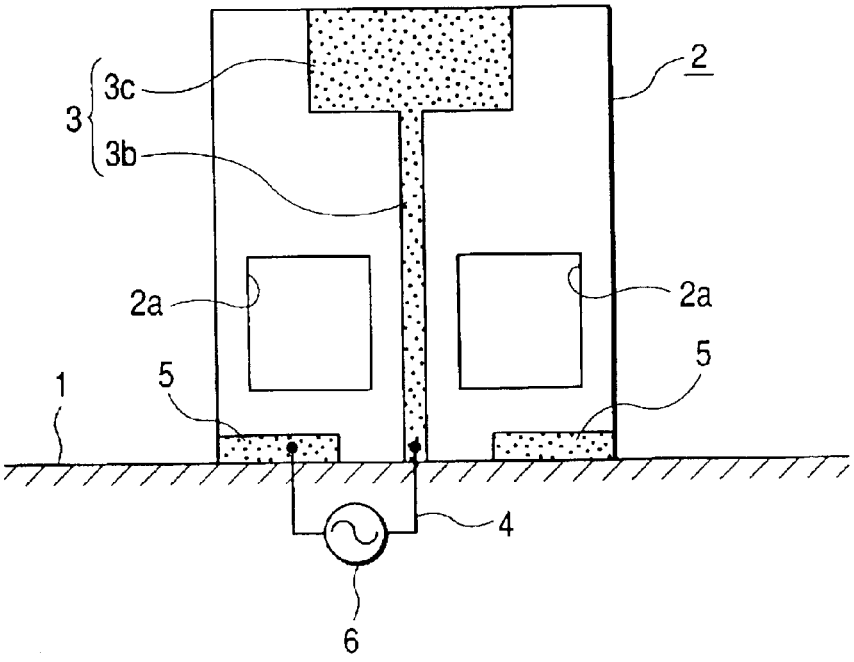
FIG. 6 is a front view of a monopole antenna according to a fifth embodiment of the invention.

FIG. 6 is a front view of a monopole antenna according to a fifth embodiment of the invention. Portions and members in FIG. 6 having counterparts in FIG. 3 are given the same reference symbols as the counterparts. In this embodiment, whereas the shape of the radiation conductor 3 is the same as in the second embodiment (see FIG. 3), a pair of through-holes 2*a* are formed through the dielectric substrate 2 in its bottom region, that is, on both sides of the narrow portion 3*b* in the width direction. The spaces in the through holes 2*a* have the same dielectric constant as air. As a result, the dielectric constant decreases around the bottom portion (inductive region) of the radiation conductor 3 and hence the inductance can be increased. Therefore, a length of the radiation conductor 3 that is necessary to attain resonance at a desired frequency can be set even smaller. That is, the height dimension of the entire monopole antenna can further be reduced. The same advantages are expected by forming thin portions, instead of the through-holes 2*a*, in a bottom region of the dielectric substrate 2.

Figure 7:
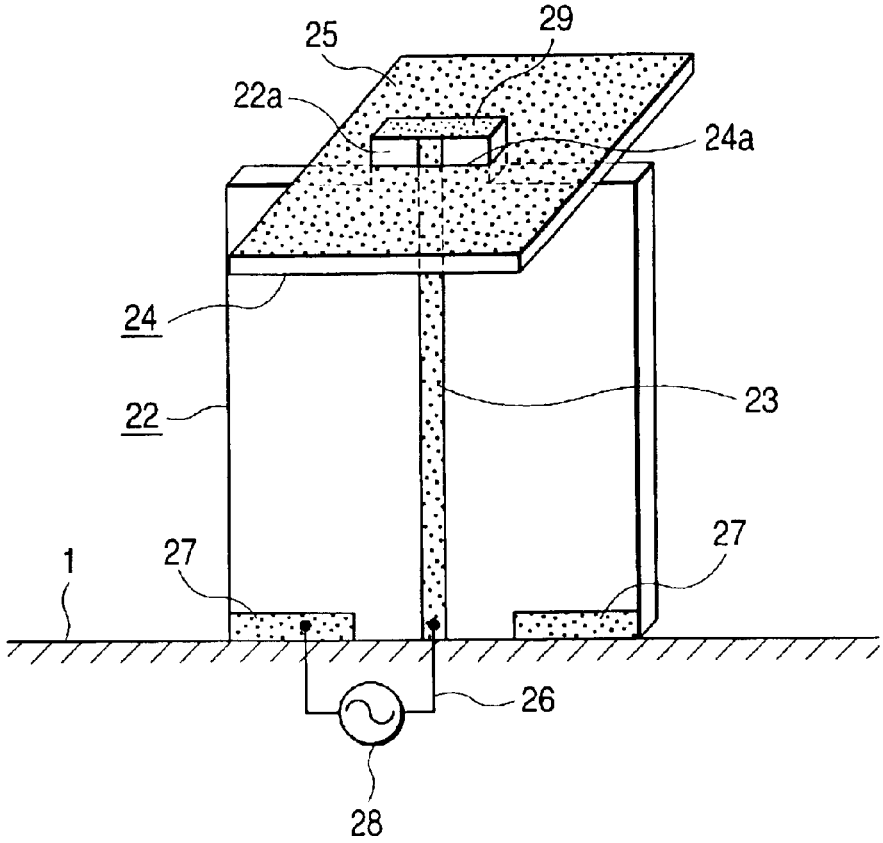
FIG. 7 is a perspective view of a monopole antenna according to a sixth embodiment of the invention.
Figure 8:
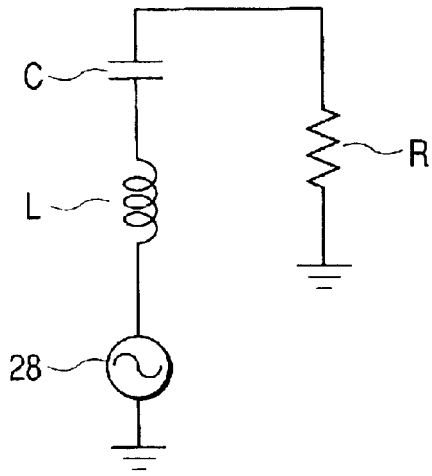
FIG. 8 is an equivalent circuit diagram of the monopole antenna of FIG. 7.

FIG. 7 is a perspective view of a monopole antenna according to a sixth embodiment of the invention. FIG. 8 is an equivalent circuit diagram of the antenna of FIG. 7.

The monopole antenna of FIG. 7 is generally composed of a dielectric substrate 22 that erects from a ground surface 1, a band-shaped first radiation conductor 23 that is formed on the surface of the dielectric substrate 22 so as to extend in the vertical direction, a small dielectric substrate 24 that is placed horizontally on the dielectric substrate 22, and a second radiation conductor 25 that is formed on the almost entire top surface of the small dielectric substrate 24. A feeder line 26 such as a coaxial cable is connected to the bottom end of the first radiation conductor 23. A central portion of the second radiation conductor 25 is connected to the top end of the first radiation conductor 23. Ground electrodes 27 are formed in a bottom end region of the dielectric substrate 22 and are soldered to the ground surface 1 of a metal plate or the like. One of the ground electrodes 27 is connected to an input voltage source 28. A high-frequency signal is supplied from the input voltage source 28 to the first radiation conductor 23 via the feeder line 26.

The dielectric substrate 22 and the small dielectric substrate 24 are formed from a common substrate. Materials such as FR-4 that are inexpensive and have relatively large relative dielectric constants ($\in r$ is about 4.8, for example) are suitable for such a dielectric substrate. A projection 22*a* that projects from the top end of the dielectric substrate 22 is inserted in a through-hole 24*a* that is formed through the small dielectric substrate 24 at its center. The two substrates 22 and 24 are integrated with each other in this state with an adhesive or the like. The portion of the first radiation conductor 23 that extends on the surface of the projection 22*a* and the second radiation conductor 25 which is formed on the surface of the small dielectric substrate 24 is electrically connected to each other via a third radiation conductor 29 that is formed on the top end face and both side faces of the projection 22*a* of the dielectric substrate 22. The second radiation conductor 25 and the third radiation conductor 29 are soldered to each other.

In this embodiment, all of the first and second radiation conductors 23 and 25 and the ground electrodes 27 are patterned into desired shapes by etching copper foil. Alternatively, the first and second radiation conductors 23 and 25 and the ground electrodes 27 of the same shapes can be formed by printing. In this embodiment, since the ground electrodes 27 in the bottom end region of the dielectric substrate 22 are soldered to the ground surface 1, it is not necessary to screw the dielectric substrate 22 on the ground surface 1 and work of connecting the monopole antenna to the feeder line 26 such as a coaxial cable can be done easily.

The monopole antenna having the above structure can be represented by the equivalent circuit shown in FIG. 8. The circuit of FIG. 8 is such that a coil L and a capacitor C are connected in series to a grounded input voltage source 28 and a grounded radiation resistor R. The top portion of the radiation conductor 23 and the second radiation conductor 25 shown in FIG. 7 can be regarded as the capacitor C shown in FIG. 8 because they are in a capacitive region having a large voltage variation. And the second radiation conductor 25 having a largest voltage variation is given a wide area. Therefore, this monopole antenna has a large capacitance, which lowers the resonance frequency. That is, if the overall height dimension is equivalent, the resonance frequency of the monopole antenna according to this embodiment is lower than that of a conventional monopole antenna in which a band-shaped radiation conductor having a constant width is formed on the surface of a dielectric substrate. Therefore, to attain resonance at a desired frequency, the height dimension of this monopole antenna can be made smaller than in the conventional one. Being an inductive region having a large current variation, the bottom portion of the first radiation conductor 23 can be regarded as the coil L shown in FIG. 8.

Providing the second radiation conductor 25 on the surface of the small dielectric substrate 24 as in this embodiment enhances the effect of lowering the resonance frequency by the wavelength shortening by the small dielectric substrate 24. It is expected that the effect of lowering the resonance frequency is obtained even in a case that the second radiation conductor 25 is a metal plate. However, providing the second radiation conductor 25 on the surface of the small dielectric substrate 24 is suitable for mass-production and hence enables cost reduction because in manufacture the first and second radiation conductors 23 and 25 can be formed together on the surfaces of the dielectric substrate 22 and the small dielectric substrate 24 that have been formed from a common substrate. In this embodiment, the second radiation conductor 25 is formed on one surface of the small dielectric substrate 24. However, if radiation conductors formed on the top and bottom surfaces of the small dielectric substrate 24 are connected to each other through a through-hole so as to serve as the second radiation conductor 25, the capacitance of the monopole antenna is further increased and hence its resonance frequency can be made even lower.

Figure 9:
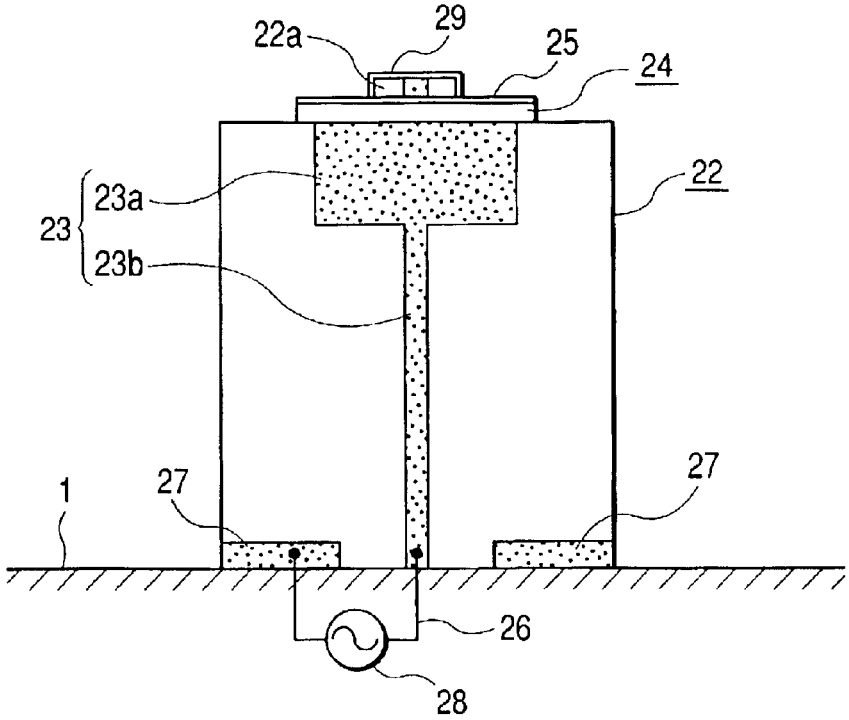
FIG. 9 is a front view of a monopole antenna according to a seventh embodiment of the invention.

FIG. 9 is a front view of a monopole antenna according to a seventh embodiment of the invention. Portions and members in FIG. 9 having counterparts in FIG. 7 are given the same reference symbols as the counterparts. In this embodiment, a top portion of the first radiation conductor 23 is a wide portion 23*a* and a portion under the wide portion 23*a* is a band-shaped narrow portion 23*b*. The small dielectric substrate 24 and the second radiation conductor 25 are smaller than in the sixth embodiment. Forming the wide portion 23*a* in the capacitive region of the first radiation conductor 23 having a large voltage variation increases the capacitance of the first radiation conductor 23. Therefore, the resonance frequency can be made as small as in the sixth embodiment even if the area of the second radiation conductor 25 is not very large. On the other hand, if the small dielectric substrate 24 and the second radiation conductor 25 have the same sizes as in the sixth embodiment, the resonance frequency can be made even lower without changing the height dimension.

Figure 10:
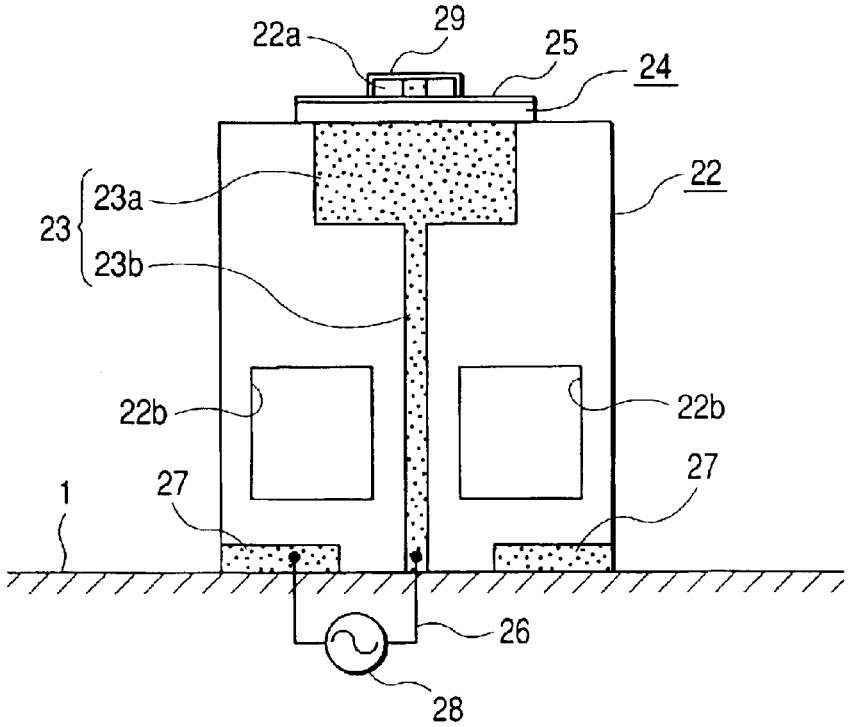
FIG. 10 is a front view of a monopole antenna according to an eighth embodiment of the invention.

FIG. 10 is a front view of a monopole antenna according to an eighth embodiment of the invention. Portions and members in FIG. 10 having counterparts in FIG. 7 or 9 are given the same reference symbols as the counterparts. In this embodiment, whereas the shape of the first radiation conductor 23 is the same as in the seventh embodiment (see FIG. 9), a pair of through-holes 22*b* are formed through the dielectric substrate 22 in its bottom region, that is, on both sides of the narrow portion 23*b* in the width direction. The spaces in the through-holes 22*b* have the same dielectric constant as air. As a result, the dielectric constant decreases around the bottom portion (inductive region) of the first radiation conductor 23 and hence the inductance can be increased. Therefore, a length of the first radiation conductor 23 that is necessary to attain resonance at a desired frequency can be set even smaller. That is, the height dimension of the entire monopole antenna can further be reduced. The same advantages are expected by forming thin portions, instead of the through-holes 22*b*, in a bottom region of the dielectric substrate 22.

Figure 11:
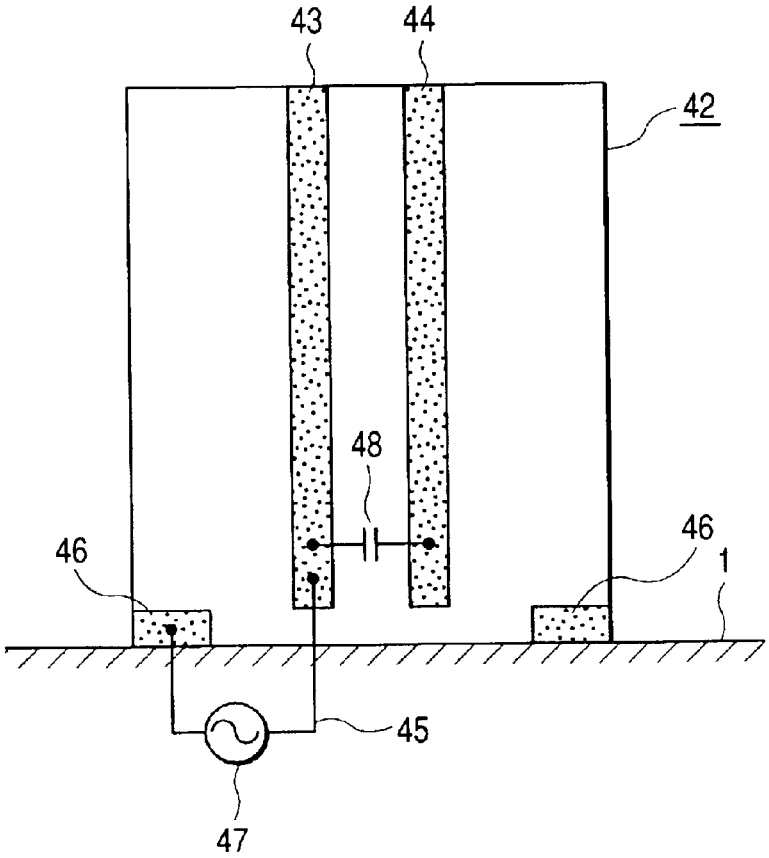
FIG. 11 is a front view of a monopole antenna according to a ninth embodiment of the invention.
Figure 12:
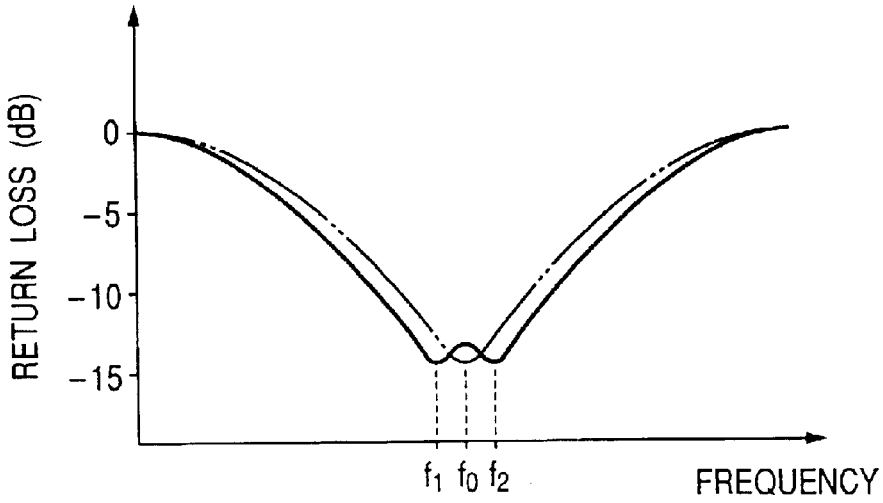
FIG. 12 is a graph showing a frequency characteristic of the monopole antenna of FIG. 11.

FIG. 11 is a front view of a monopole antenna according to a ninth embodiment of the invention. FIG. 12 is a graph showing a frequency characteristic of the antenna of FIG. 11.

The monopole antenna of FIG. 11 is generally composed of a dielectric substrate 42 that erects from a ground surface 1 and two radiation conductors 43 and 44 that are formed on the surface of the dielectric substrate 42 so as to extend parallel with each other in the vertical direction and that are slightly different from each other in length. A feeder line 45 such as a coaxial cable is connected to the bottom end of the first radiation conductor 43. Ground electrodes 46 are formed in a bottom end region of the dielectric substrate 42 and are soldered to the ground surface 1 of a metal plate or the like. One of the ground electrodes 46 is connected to an input voltage source 47. A prescribed high-frequency signal is supplied from the input voltage source 47 to the bottom end of the first radiation conductor 43 via the feeder line 45. Since the first radiation conductor 43 and the second radiation conductor 44 are coupled to each other via a capacitor 48 for impedance adjustment, the same high-frequency signal is supplied to the bottom end of the second radiation conductor 44.

Materials such as FR-4 that are inexpensive and have relatively large relative dielectric constants ($\in r$ is about 4.8, for example) are suitable for the dielectric substrate 42. In this embodiment, the first and second radiation conductors 43 and 44 and the ground electrodes 46 are patterned into desired shapes by etching copper foil. Alternatively, the first and second radiation conductors 43 and 44 and the ground electrodes 46 of the same shapes can be formed by printing.

The above-configured monopole antenna has a frequency characteristic that is indicated by a solid line in FIG. 12. Since the pair of radiation conductors 43 and 44 that are slightly different from each other in length are formed on the surface of the dielectric substrate 42 parallel with each other, the monopole antenna can resonate with both of radio waves, having a wavelength (frequency $f_1$) corresponding to the length of the first radiation conductor 43 and radio waves having a wavelength (frequency $f_2$) corresponding to the length of the second radiation conductor 44. A curve of a two-dot chain line in FIG. 12 represents a frequency characteristic of a comparative example in which a single radiation conductor that resonates with radio waves having a frequency $f_0$ ($f_1<f_0<f_2$) is formed on the surface of the dielectric substrate 42. It is seen that the resonance frequency band is much wider in this embodiment in which the two radiation conductors 43 and 44 are provided than in the comparative example. Since the first and second radiation conductors 43 and 44 are formed on the surface of the dielectric substrate 42, their lengths can be set shorter in consideration of the wavelength shortening by the dielectric. That is, the monopole antenna according to this embodiment not only has the wide resonance frequency band and hence is expected to always provide high sensitivity but also has a small height dimension and hence is suitable for miniaturization.

Figure 13:
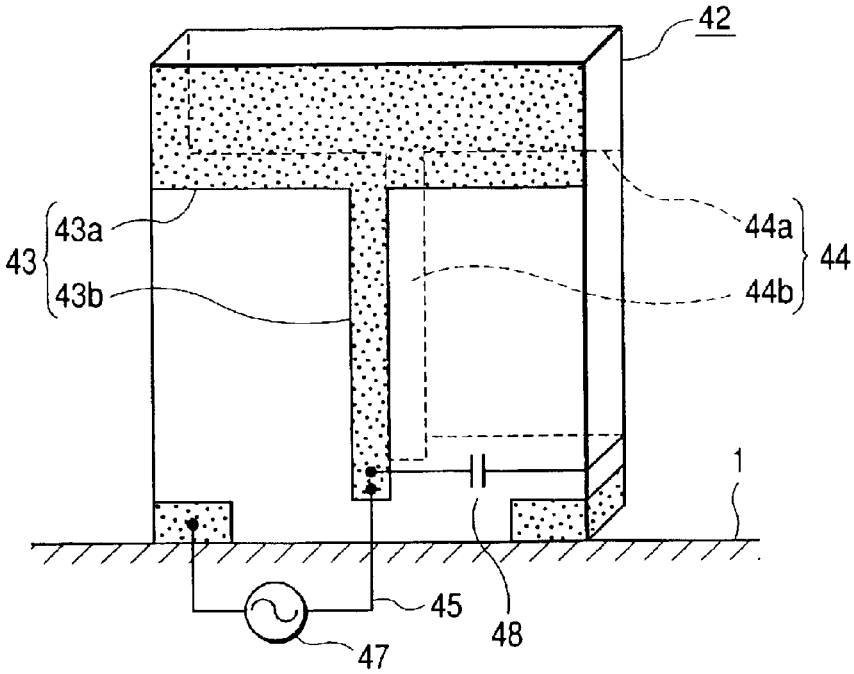
FIG. 13 shows the structure of a monopole antenna according to a 10th embodiment of the invention.

FIG. 13 shows the structure of a monopole antenna according to a 10th embodiment of the invention. Portions and members in FIG. 13 having counterparts in FIG. 11 are given the same reference symbols as the counterparts.

The 10th embodiment is different from the ninth embodiment in that a first radiation conductor 43 is formed on one surface of the dielectric substrate 42 and a second radiation conductor 44 is formed on the other surface and that top portions of the respective radiation conductors 43 and 44 are wide. The top portion, formed on the one surface of the dielectric substrate 42, of the first radiation conductor 43 is a wide portion 43*a* whose width is approximately equal to the overall width of the dielectric substrate 42. A narrow portion 43*b* is formed under the wide portion 43*a* so as to be continuous with the latter. Similarly, the top portion, formed on the opposite surface of the dielectric substrate 42, of the second radiation conductor 44 is a wide portion 44*a* whose width is approximately equal to the overall width of the dielectric substrate 42. A narrow portion 44*b* is formed under the wide portion 44*a* so as to be continuous with the latter. As in the case of the ninth embodiment, the overall length of the second radiation conductor 44 is slightly smaller than that of the first radiation conductor 43 and the radiation conductors 43 and 44 are coupled to each other via a capacitor 48 for impedance adjustment.

Forming the first and second radiation conductors 43 and 44 on the front surface and the back surface of the dielectric substrate 42 in the above-described manner makes it possible to make part of each of the radiation conductors 43 and 44 wide without causing any problems. The design in which the top portion (capacitive region), distant from the ground surface 1, of each of the first and second radiation conductors 43 and 44 is wide increases the capacitance of each of the first and second radiation conductors 43 and 44. In general, the resonance frequency of a resonance circuit lowers as its capacitance increases. Therefore, according to this embodiment, a length dimension of each of the radiation conductors 43 and 44 that is necessary to attain resonance at a desired frequency can be reduced. This means an advantage that the height dimension of the entire monopole antenna can be reduced.

Figure 14:
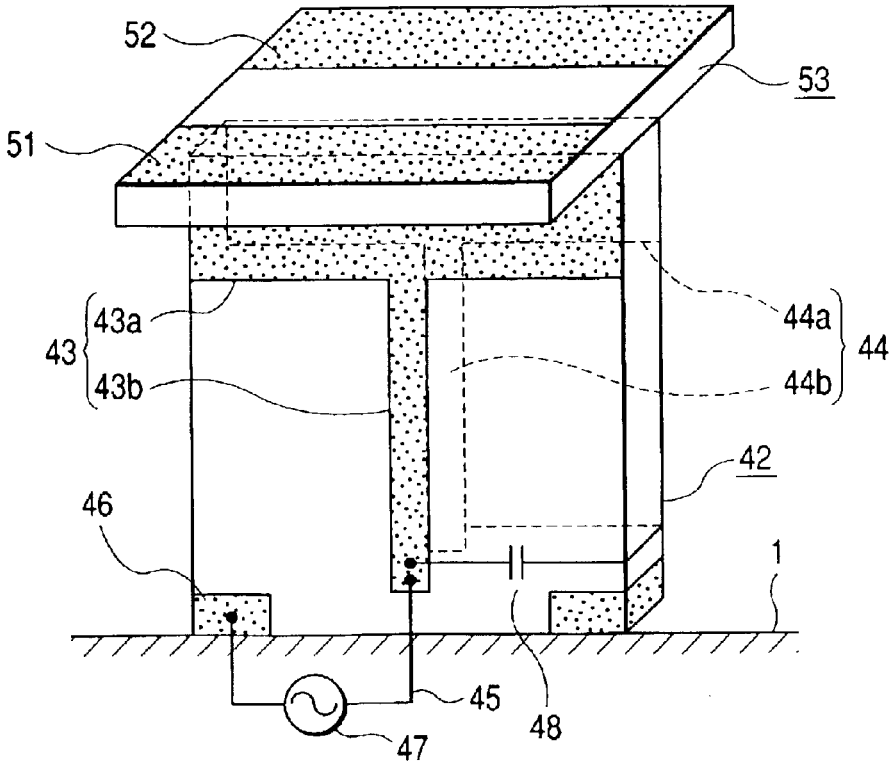
FIG. 14 shows the structure of a monopole antenna according to an 11th embodiment of the invention.

FIG. 14 shows the structure of a monopole antenna according to an 11th embodiment of the invention. Portions and members in FIG. 14 having counterparts in FIG. 11 or 13 are given the same reference symbols as the counterparts.

In the 11th embodiment, a small dielectric substrate 53 is placed on the dielectric substrate 42 so as to be approximately perpendicular to the latter and a third radiation conductor 51 and a fourth radiation conductor 52 are formed on the surface of the small dielectric substrate 53 parallel with each other at a prescribed interval. The third radiation conductor 51 is connected, through a through-hole (not shown), to the first radiation conductor 43 that is formed on one surface of the dielectric substrate 42. The fourth radiation conductor 52 is connected, through a through-hole (not shown), to the second radiation conductor 44 that is formed on the other surface of the dielectric substrate 42. The small dielectric substrate 53 and the dielectric substrate 42 are formed from a common substrate, and are integrated with each other with an adhesive or the like.

Placing the third radiation conductor 51 having a large capacitance on top of the first radiation conductor 43 in the above-described manner makes the resonance frequency even lower. Similarly, placing the fourth radiation conductor 52 having a large capacitance on top of the second radiation conductor 44 in the above-described manner makes the resonance frequency even lower. Also given the wavelength shortening effect of the small dielectric substrate 53, the monopole antenna according to this embodiment can be made smaller in height dimension than that according to the 10th embodiment.

Figure 15:
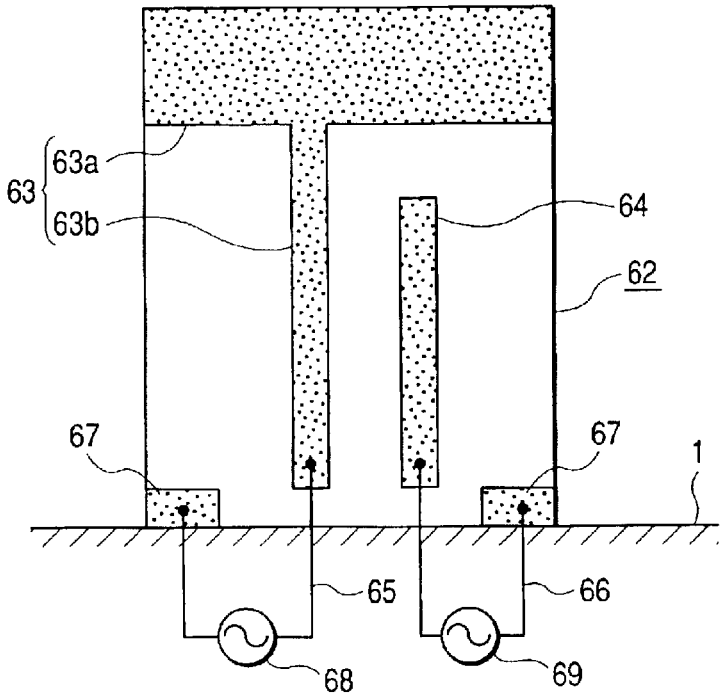
FIG. 15 is a front view of a dual-band monopole antenna according to a 12th embodiment of the invention.
Figure 16:
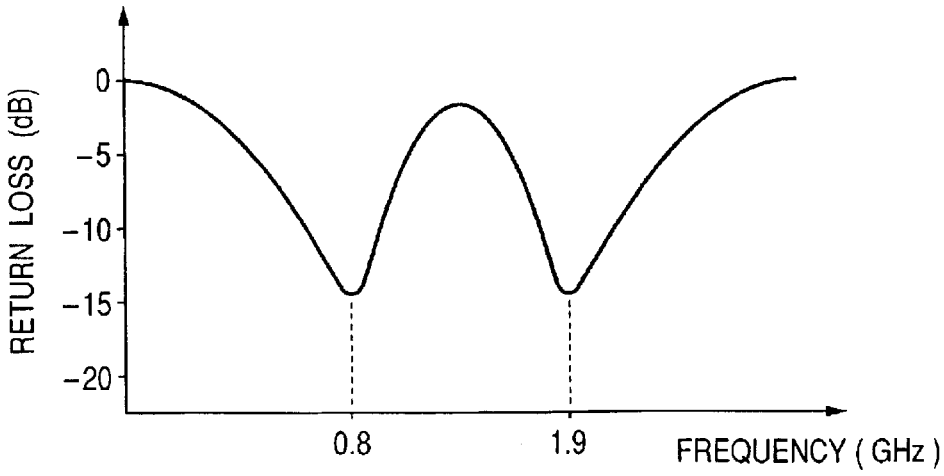
FIG. 16 is a graph showing a frequency characteristic of the monopole antenna of FIG. 15.

FIG. 15 is a front view of a dual-band monopole antenna according to a 12th embodiment of the invention. FIG. 16 is a graph showing a frequency characteristic of the antenna of FIG. 15.

The monopole antenna of FIG. 15 is generally composed of a dielectric substrate 62 that erects from a ground surface 1 and two radiation conductors 63 and 64 that are formed on the surface of the dielectric substrate 62 so as to extend in the vertical direction and have different lengths. Feeder lines 65 and 66 such as coaxial cables are connected to the bottom ends of the first radiation conductor 63 and the second radiation conductor 64, respectively. Ground electrodes 67 are formed in a bottom end region of the dielectric substrate 62 and are soldered to the ground surface 1 of a metal plate or the like. The ground electrodes 67 are connected to respective input voltage sources 68 and 69. A first high-frequency signal is supplied from the input voltage source 68 to the first radiation conductor 63 via the feeder line 65, and a second high-frequency signal is supplied from the input voltage source 69 to the second radiation conductor 64 via the feeder line 66. The first radiation conductor 63 is to send and receive radio waves of an 800-MHz band. A top portion of the first radiation conductor 63 is a wide portion 63*a* whose width is approximately equal to the over all width of the dielectric substrate 62. A band-shaped narrow portion 63*b* is formed under the wide portion 63*a* so as to be continuous with the latter. The second radiation conductor 64 is to send and receive radio waves of a 1.9-GHz band. The length dimension of the second radiation conductor 64 is slightly smaller than that of the narrow portion 63*b* of the first radiation conductor 63. That is, since the frequency of the second high-frequency signal that is supplied to the second radiation conductor 64 is set higher than that of the first high-frequency signal that is supplied to the first radiation conductor 63, the second radiation conductor 64 is shorter than the first radiation conductor 63.

Materials such as FR-4 that are inexpensive and have relatively large relative dielectric constants ($\in r$ is about 4.8, for example) are suitable for the dielectric substrate 62. In this embodiment, the first and second radiation conductors 63 and 64 and the ground electrodes 67 are patterned into desired shapes by etching copper foil. Alternatively, the first and second radiation conductors 63 and 64 and the ground electrodes 67 of the same shapes can be formed by printing.

The above-configured monopole antenna has a frequency characteristic shown in FIG. 16. The return loss steeply decreases in the 800-MHz band where the first radiation conductor 63 resonates and the 1.9-GHz band where the second radiation conductor 64 resonates; it is seen that this monopole antenna operates in these two bands. To decrease the height of this dual-band monopole antenna, it is necessary to reduce the height dimension of the first radiation conductor 63 for the lower-frequency (800 MHz) band. In this embodiment, since the first radiation conductor 63 has the wide portion 63*a* as the top portion and is formed on the dielectric substrate 62, the height dimension is much smaller than in conventional monopole antennas. In monopole antennas, a capacitive region exists in a top portion that is distant from the ground surface. Therefore, making a radiation conductor wide in the capacitive region increases the capacitance, which lowers the resonance frequency. Further, if a substrate on which the radiation conductor is formed is a dielectric, the wavelength of radio waves with which the radiation conductor resonates is shortened and hence a shorter radiation conductor suffices. Therefore, in this embodiment, the first radiation conductor 63 which is formed on the surface of the dielectric substrate 62 and has the wide portion 63*a* as the top portion has a length of about 4 cm that is extremely small for a radiation conductor for the 800-MHz band. The height dimension of the entire monopole antenna is so small as not to cause any problems when it is installed in a vehicle compartment. The height dimension of the second radiation conductor 64 for the higher-frequency (1.9 GHz) band can be set to about 3 cm in consideration of the wavelength shortening effect of the dielectric substrate 62, and hence it is not necessary to make its top portion wide.

Figure 17:
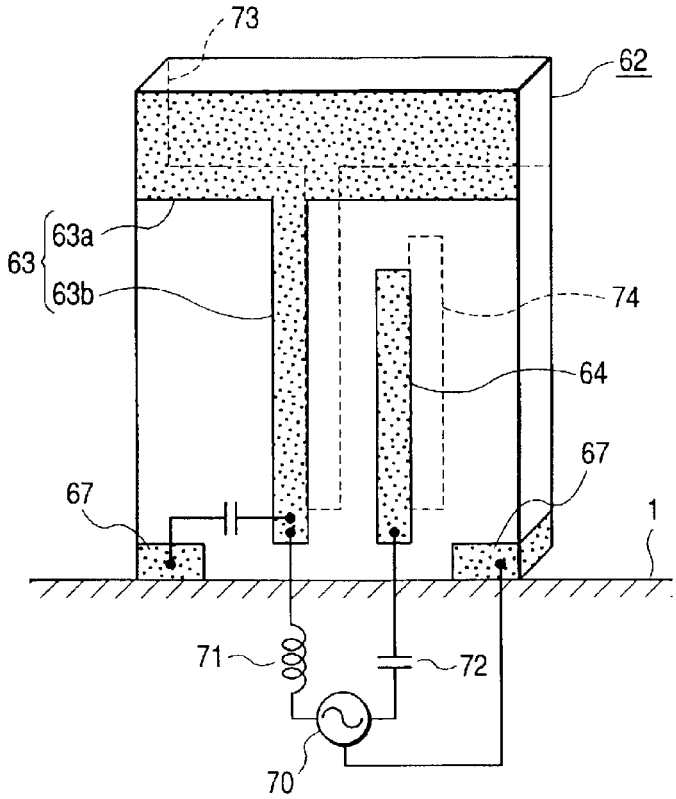
FIG. 17 shows the structure of a dual-band monopole antenna according to a 13th embodiment of the invention.
Figure 18:
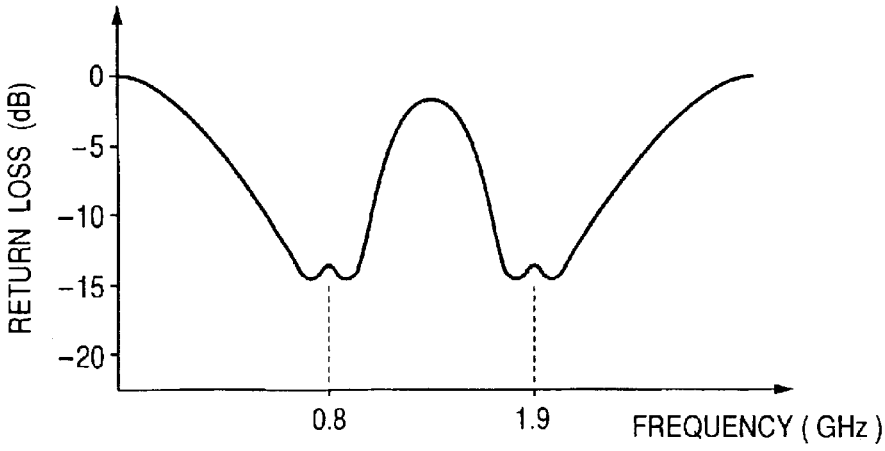
FIG. 18 is a graph showing a frequency characteristic of the monopole antenna of FIG. 17.

FIG. 17 shows the structure of a dual-band monopole antenna according to a 13th embodiment of the invention. Portions and members in FIG. 17 having counterparts in FIG. 15 are given the same reference symbols as the counterparts. FIG. 18 is a graph showing a frequency characteristic of the monopole antenna of FIG. 17.

The 13th embodiment is different from the 12th embodiment in that radiation conductors are formed on the front surface and the back surface of the dielectric substrate 62 and a common input voltage source is used for the higher-frequency band and the lower-frequency band. More specifically, as shown in FIG. 17, a first radiation conductor 63 and a second radiation conductor 64 having the same shapes as in the 12th embodiment are formed on one surface of the dielectric substrate 62. And a third radiation conductor 73 that has approximately the same shape as the first radiation conductor 63 and is slightly different from the latter in the length dimension in the vertical direction and a fourth radiation conductor 74 that has approximately the same shape as the second radiation conductor 64 and is slightly different from the latter in the length dimension in the vertical direction are formed on the opposite surface of the dielectric substrate 62. Although not shown in FIG. 17, the first and third radiation conductors 63 and 73 are coupled to each other via a capacitor for impedance adjustment and a first high-frequency signal is supplied to the bottom ends of the two radiation conductors 63 and 73. Similarly, the second and fourth radiation conductors 64 and 74 are coupled to each other via a capacitor for impedance adjustment and a second high-frequency signal is supplied to the bottom ends of the two radiation conductors 64 and 74.

With the above structure, the first and third radiation conductors 63 and 73 resonate with radio waves having frequencies that are slightly deviated from 800 MHz and the second and fourth radiation conductors 64 and 74 resonate with radio waves having frequencies that are slightly deviated from 1.9 GHz. As a result, as shown in FIG. 18, wider resonation bands are obtained at 800 MHz and 1.9 GHz.

In the 13th embodiment, a common input voltage source 70 is used because a branching circuit that passes signals having particular frequencies are incorporated. More specifically, a lower, first high-frequency signal is supplied to the first and third radiation conductors 63 and 73 via a coil 71 and a higher, second high-frequency signal is supplied to the second and fourth radiation conductors 64 and 74 via a capacitor 72. In this manner, the circuit configuration can be simplified by branching a signal that is supplied from the common input voltage source 70 with the branching circuit and supplying resulting signals to the respective pairs of radiation conductors.

Figure 19:
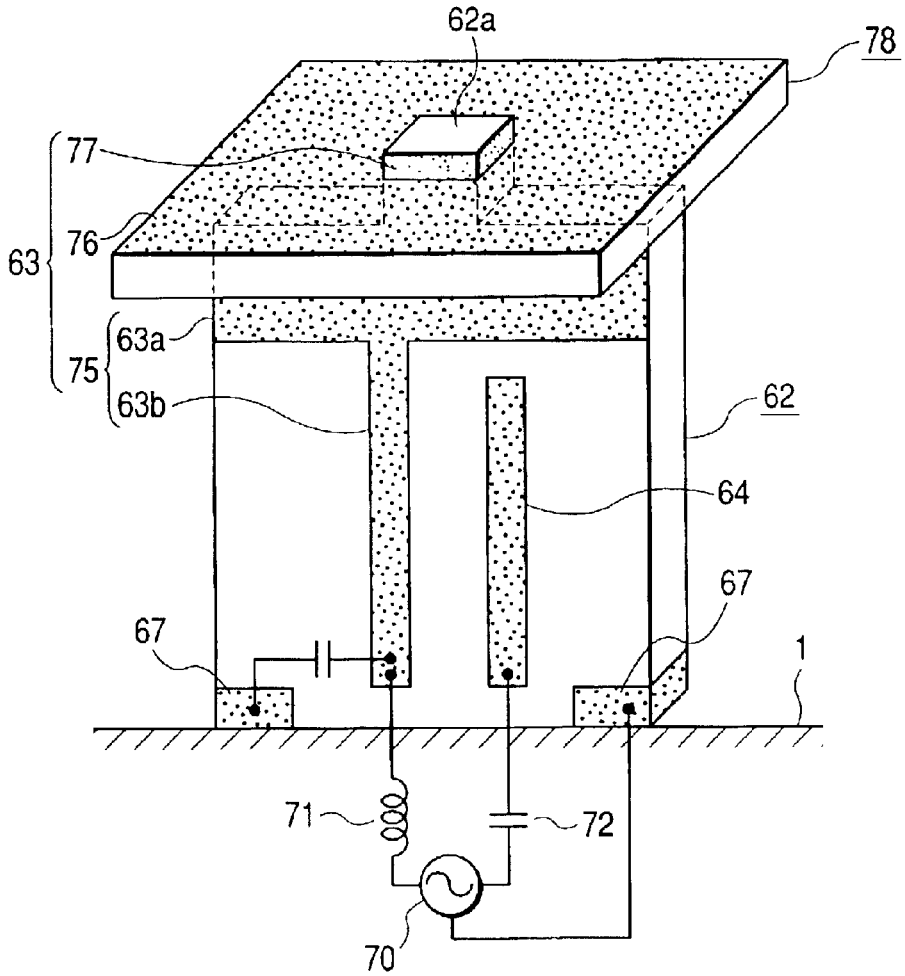
FIG. 19 shows the structure of a dual-band monopole antenna according to a 14th embodiment of the invention.

FIG. 19 shows the structure of a dual-band monopole antenna according to a 14th embodiment of the invention. Portions and members in FIG. 19 having counterparts in FIG. 15 or 17 are given the same reference symbols as the counterparts.

In the 14th embodiment, a small dielectric substrate 78 is placed on the dielectric substrate 62 so as to be approximately perpendicular to the latter and a horizontal portion 76 of a first radiation conductor 63 is formed on the almost entire surface of the small dielectric substrate 78. The small dielectric substrate 78 and the dielectric substrate 62 are formed from a common substrate. The substrates 62 and 78 are integrated with each other with an adhesive or the like in a state that a projection 62*a* of the dielectric substrate 62 is inserted in a central through-hole of the small dielectric substrate 78. The first radiation conductor 63 is composed of an erect portion 75 that is formed on the surface of the dielectric substrate 62 so as to extend in the vertical direction, the horizontal portion 76 that is formed parallel with the surface of the small dielectric substrate 78, and a connecting portion 77 that is formed on the projection 62*a* of the dielectric substrate 62. The erect portion 75 and the horizontal portion 76 are connected to each other by the connecting portion 77. The erect portion 75 consists of a wide portion 63*a* and a narrow portion 63*b* that have approximately the same shapes as in the 12th and 13th embodiments. The connecting portion 77 is continuous with the top end of the wide portion 63*a*. The connecting portion 77 is soldered to the horizontal portion 76.

Providing the horizontal portion 76 having a large capacitance as a top portion of the first radiation conductor 63 for the lower-frequency (800 MHz) band makes the resonance frequency even lower. Also with the wavelength shortening effect of the small dielectric substrate 78, in this embodiment, the length dimension of the first radiation conductor 63 can be made even smaller than in the 12th and 13th embodiments and hence the height dimension of the entire monopole antenna can further be reduced. Also in this embodiment, a first high-frequency signal and a second high-frequency signal are supplied to the first radiation conductor 63 and the second radiation conductor 64, respectively, from the common input voltage source 70 via the branching circuit having the coil 71 and the capacitor 72.

Figure 20:
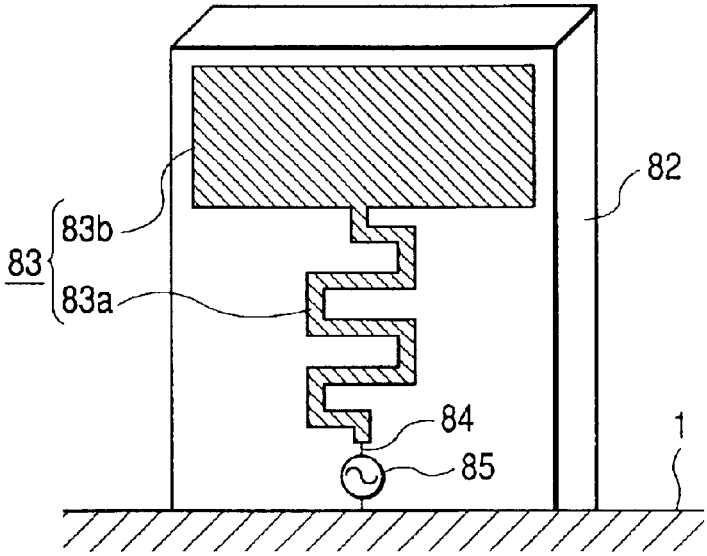
FIG. 20 is a front view of a monopole antenna according to a 15th embodiment of the invention.

FIG. 20 is a front view of a monopole antenna according to a 15th embodiment of the invention.

As shown in FIG. 20, the monopole antenna according to this embodiment is generally composed of a dielectric substrate 82 that erects from a ground surface 1 of a metal plate and a radiation conductor 83 that is formed on the surface of the dielectric substrate 82. A prescribed high-frequency signal is supplied form an input voltage source 85 to the bottom end of the radiation conductor 83 via a feeder line 84 such as a coaxial cable. The radiation conductor 83 consists of a lower, zigzagged band-shaped portion 83*a* and an upper wide portion 83*b*. The wide portion 83*b* is a conductor portion that is much wider than the zigzagged band-shaped portion 83*a*. On the other hand, the zigzagged band-shaped portion 83*a* extends in the vertical direction as a whole while its actual extension direction varies in crank form. The top end of the zigzagged band-shaped portion 83*a* is continuous with the bottom end of the wide portion 83*b*.

Although in this embodiment the radiation conductor 83 is patterned by etching copper foil that is formed on the entire surface of the dielectric substrate 82, the radiation conductor 83 having the same shape can be formed by printing. Materials such as FR-4 that are inexpensive and have relatively large relative dielectric constants ($\in r$ is about 4.8, for example) are suitable for the dielectric substrate 82.

In the monopole antenna having the above structure, since the radiation conductor 83 has the zigzagged band-shaped portion 83*a*, the length dimension (overall length) of the radiation conductor 83 as measured along its actual extension direction is much larger than its height dimension (overall height). Therefore, if having the same height dimension as an ordinary radiation conductor that extends straightly in the vertical direction, the radiation conductor 83 having the zigzagged band-shaped portion 83*a* resonates with radio waves having a longer wavelength and hence the resonance frequency is lower. Consequently, a height dimension of the radiation conductor 83 that is necessary to attain resonance at a desired frequency can be reduced. The dielectric substrate 82 shortens the wavelength of radio waves with which the radiation conductor 83 resonates. With this wavelength shortening effect taken into consideration, it can be said that the height dimension of the radiation conductor 83 can be reduced to a large extent.

The monopole antenna of FIG. 20 has a large capacitance because the radiation conductor 83 has the wide portion 83*b* as a top portion (capacitive region) where the voltage varies greatly. In general, the resonance frequency of a resonance circuit lowers as its capacitance increases. Therefore, according to this embodiment, a height dimension of the radiation conductor 83 that is necessary to attain resonance at a desired frequency can further be reduced. As a result, the height dimension of the entire monopole antenna can be made much smaller than that of conventional ones; miniaturization and height reduction that are suitable for vehicular or portable use are attained.

Figure 21:
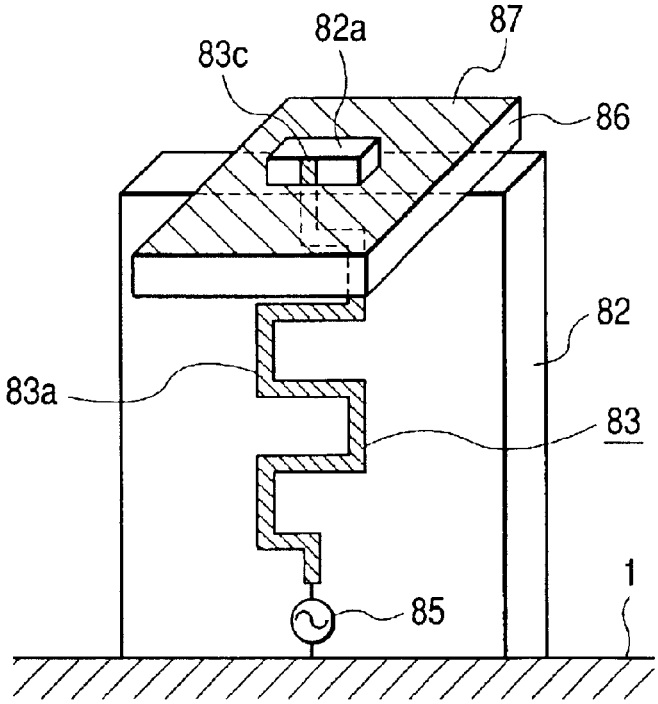
FIG. 21 is a front view of a monopole antenna according to a 16th embodiment of the invention.

FIG. 21 is a front view of a monopole antenna according to a 16th embodiment of the invention. Portions and members in FIG. 21 having counterparts in FIG. 20 are given the same reference symbols as the counterparts.

As shown in FIG. 21, the monopole antenna according to this embodiment is much different from the 15th embodiment in that the wide portion 83*b* is omitted and the zigzagged band-shaped portion 83*a* extends to the top end of the dielectric substrate 82 and that a second radiation conductor 87 is formed on the almost entire-surface of a small dielectric substrate 86 that is placed on the dielectric substrate 82, the second radiation conductor 87 being connected to the radiation conductor 83. The small dielectric substrate 86 and the dielectric substrate 82 are formed from a common substrate. The two substrates 82 and 86 are integrated with each other with an adhesive or the like in a state that a projection 82*a* of the dielectric substrate 82 is inserted in a central through-hole of the small dielectric substrate 86. The zigzagged band-shaped portion 83*a* accounts for most of the radiation conductor 83 that is formed on the surface of the dielectric substrate 82. A connecting conductor portion 83*c* that is formed on the surface of the projection 82*a* and is continuous with the top end of the zigzagged band-shaped portion 83*a* is soldered to the second radiation conductor 87.

Providing, in this manner, the second radiation conductor 87 having a large capacitance on top of the radiation conductor 83 most of which is the zigzagged band-shaped portion 83*a* can also lower the resonance frequency considerably and hence can reduce the height dimension of the entire monopole antenna to a large extent. This embodiment is also given the wavelength shortening effect of the small dielectric substrate 86 in addition to that of the dielectric substrate 82, which is advantageous in making the monopole antenna more compact and smaller in height. However, it is possible to omit the small dielectric substrate 86 and to cause a metal plate that is placed on the dielectric substrate 82 to function as the second radiation conductor 87.

Figure 22:
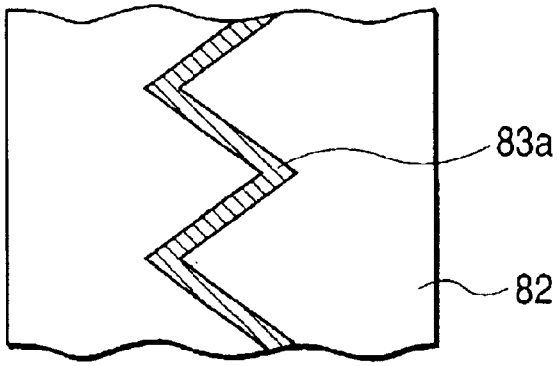
FIG. 22 shows a modification of a radiation conductor.
Figure 23:
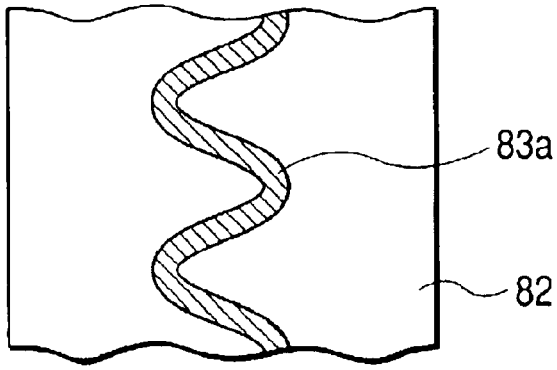
FIG. 23 shows another modification of the radiation conductor.

In the 15th and 16th embodiments, the zigzagged band-shaped portion 83*a* of the radiation conductor 83 extends in the vertical direction as a whole while its actual extension direction varies in crank form. However, the shape of the zigzagged band-shaped portion 83*a* is not limited to it. For example, as shown in FIG. 22, the zigzagged band-shaped portion 83*a* may extend in the vertical direction as a whole while its actual extension direction varies in saw-tooth form. As another alternative, as shown in FIG. 23, the zigzagged band-shaped portion 83*a* may extend in the vertical direction as a whole while its actual extension direction varies in wave form.

When practiced in the above-described forms, the invention provides the following advantages.

Since the top portion (capacitive region), having a large voltage variation, of the radiation conductor is wide, the capacitance is increased and the resonance frequency decreases. Therefore, a height dimension of the radiation conductor for attaining resonance at a desired frequency can be made much smaller than in conventional monopole antennas. The invention makes it possible to provide a monopole antenna that can easily be reduced in height dimension and hence is favorable for miniaturization.

A maximum voltage variation occurs in the second radiation conductor which is connected to the top end of the first radiation conductor. Since the second radiation conductor is extended to a plane that is approximately perpendicular to the dielectric substrate, the capacitance is large there and the second radiation conductor serves to lower the resonance frequency of the monopole antenna. This makes it possible to make an overall height dimension for attaining resonance at a desired frequency much shorter than in conventional monopole antennas. The invention makes it possible to provide a monopole antenna that can easily be reduced in height dimension and hence is favorable for acceleration of miniaturization.

By coupling appropriately together two radiation conductors that are slightly different from each other in length by using a capacitor or the like, the monopole antenna can resonate with two kinds of radio waves whose wavelengths correspond to the lengths of the two radiation conductors, respectively, whereby the resonance frequency band can be widened to a large extent. Since the two radiation conductors are formed on the surface of the dielectric substrate, the length of each radiation conductor can be set smaller with an additional effect of wavelength shortening by the dielectric. Therefore, the invention makes it possible to provide a superior monopole antenna that has a wide resonance frequency band and hence can be reduced in height dimension.

Making wide the top portion (capacitive region) of the long radiation conductor (first radiation conductor) to resonate with radio waves having a lower frequency or providing the horizontal portion as a top portion of the radiation conductor can increase its capacitance and hence lower the resonance frequency. Also with the wavelength shortening effect of the dielectric substrate on which the radiation conductor is formed, a length dimension of the radiation conductor that is necessary to attain resonance at a desired frequency can be reduced to a large extent. As such, the invention can provide a dual-band monopole antenna that can be reduced in height dimension to a large extent and hence is suitable for miniaturization.

Providing the radiation conductor with the zigzagged band-shaped portion enables resonance with radio waves having a longer wavelength, that is, lowers the resonance frequency. Also with the wavelength shortening effect of the dielectric substrate, a height of the radiation conductor that is necessary to attain resonance at a desired frequency can be reduced to a large extent. As such, the invention can provide a monopole antenna that can easily be reduced in height dimension and hence can accelerate miniaturization and height reduction.

What is claimed is:

1. A monopole antenna comprising:

a dielectric substrate that erects from a ground surface; and a radiation conductor that is provided on a surface of the dielectric substrate so as to extend in the vertical direction, a bottom end of the radiation conductor being connected to a feeder line, the radiation conductor having a bottom portion and a top portion that is distant from the ground surface and is wider than the bottom portion, wherein the dielectric substrate is formed with through-holes or thin portions in a bottom region.

2. The monopole antenna according to claim 1, further comprising a ground electrode that is provided on the dielectric substrate in a bottom end region and is soldered to the ground surface.

3. A monopole antenna comprising:

a dielectric substrate that erects from a ground surface;

a first radiation conductor that is provided on a surface of the dielectric substrate so as to extend in the vertical direction, a bottom end of the first radiation conductor being directly connected to a feeder line; and a second radiation conductor that extends parallel with a plane that is approximately perpendicular to the dielectric substrate, the second radiation conductor being connected to a top end of the first radiation conductor.

4. The monopole antenna according to claim 3, further comprising a small dielectric substrate that is provided on the dielectric substrate so as to be approximately perpendicular to the dielectric substrate, wherein the second radiation conductor is provided on one or both surfaces of the small dielectric substrate.

5. The monopole antenna according to claim 3, wherein the first radiation conductor has a bottom portion and a top portion.

6. The monopole antenna according to claim 3, wherein the dielectric substrate is formed with through-holes or thin portions in a bottom region.

7. The monopole antenna according to claim 3, further comprising a ground electrode that is provided on the dielectric substrate in a bottom end region and is soldered to the ground surface.

8. A monopole antenna comprising:

a dielectric substrate that erects from a ground surface;

a first radiation conductor that is provided on a surface of the dielectric substrate so as to extend in the vertical direction and has a feeding point at a bottom end; and a second radiation conductor that is provided on a surface of the dielectric substrate so as to have approximately the same shape as the first radiation conductor and to have a parallel positional relationship with the first radiation conductor, and that has a feeding point at a bottom end, wherein the first and second radiation conductors have different lengths and signals having the same frequency are supplied to the feeding points of the first and second radiation conductors, respectively.

9. The monopole antenna according to claim 8, wherein the first radiation conductor is provided on one surface of the dielectric substrate and the second radiation conductor is provided on an opposite surface of the dielectric substrate.

10. The monopole antenna according to claim 9, wherein each of the first and second radiation conductors has a wide top portion that is distant from the ground surface.

11. The monopole antenna according to claim 8, further comprising:

a third radiation conductor that is provided on the dielectric substrate so as to extend parallel with a plane that is approximately perpendicular to the dielectric substrate, the third radiation conductor being connected to a top end of the first radiation conductor; and a fourth radiation conductor that is provided on the dielectric substrate so as to extend parallel with a plane that is approximately perpendicular to the dielectric substrate, the fourth radiation conductor being connected to a top end of the second radiation conductor.

12. The monopole antenna according to claim 11, further comprising a small dielectric substrate that is provided on the dielectric substrate so as to be approximately perpendicular to the dielectric substrate wherein the third and fourth radiation conductors are provided on a surface of the small dielectric substrate.

13. A monopole antenna comprising:

a dielectric substrate that erects from a ground surface;

a first radiation conductor that is provided on a surface of the dielectric substrate so as to extend in the vertical direction and to have a wide top portion; and a second radiation conductor that is provided on the surface of the dielectric substrate so as to extend in the vertical direction and to have a smaller length dimension than the first radiation conductor, wherein a first high-frequency signal is supplied to the first radiation conductor via a feeding point that is provided at a bottom end of the first radiation conductor and a second high-frequency signal having a higher frequency than the first high-frequency signal is supplied to the second radiation conductor via a feeding point that is provided at a bottom end of the second radiation conductor.

14. The monopole antenna according to claim 13, further comprising a third radiation conductor that has approximately the same shape as and a different length dimension in the vertical direction than the first radiation conductor provided on one surface of the dielectric substrate and that is provided on an opposite surface of the dielectric substrate, wherein the first high-frequency signal is supplied to a bottom end of the third radiation conductor.

15. The monopole antenna according to claim 14, further comprising a fourth radiation conductor that has approximately the same shape as and a different length dimension in the vertical direction than the second radiation conductor provided on one surface of the dielectric substrate and that is provided on an opposite surface of the dielectric substrate, wherein the second high-frequency signal is supplied to a bottom end of the fourth radiation conductor.

16. The monopole antenna according to claim 13, wherein the first high-frequency signal is supplied from an input voltage source to the first radiation conductor via a coil, and the second high-frequency signal is supplied from the input voltage source to the second radiation conductor via a capacitor.

17. A monopole antenna comprising:

a dielectric substrate that erects from a ground surface;

a first radiation conductor having an erect portion that is provided on a surface of the dielectric substrate so as to extend in the vertical direction and a horizontal portion that is provided on the dielectric substrate so as to extend horizontally and is connected to a top end of the erect portion; and a second radiation conductor that is provided on the surface of the dielectric substrate so as to extend in the vertical direction and has a smaller length dimension than the first radiation conductor, wherein a first high-frequency signal is supplied to the first radiation conductor via a feeding point that is provided at a bottom end of the first radiation conductor and a second high-frequency signal having a higher frequency than the first high-frequency signal is supplied to the second radiation conductor via a feeding point that is provided at a bottom end of the second radiation conductor.

18. The monopole antenna according to claim 17, further comprising a small dielectric substrate that is provided on the dielectric substrate so as to be approximately perpendicular to the dielectric substrate, wherein the horizontal portion of the first radiation conductor is provided on a surface of the small dielectric substrate.

19. The monopole antenna according to claim 17, wherein the erect portion of the first radiation conductor has a wide top portion.

20. The monopole antenna according to claim 17, wherein the first high-frequency signal is supplied from an input voltage source to the first radiation conductor via a coil, and the second high-frequency signal is supplied from the input voltage source to the second radiation conductor via a capacitor.

21. The monopole antenna according to claim 17, further comprising a third radiation conductor that has approximately the same shape as and a different length dimension in the vertical direction than the first radiation conductor provided on one surface of the dielectric substrate and that is provided on an opposite surface of the dielectric substrate, wherein the first high-frequency signal is supplied to a bottom end of the third radiation conductor.

22. The monopole antenna according to claim 21, further comprising a fourth radiation conductor that has approximately the same shape as and a different length dimension in the vertical direction than the second radiation conductor provided on one surface of the dielectric substrate and that is provided on an opposite surface of the dielectric substrate, wherein the second high-frequency signal is supplied to a bottom end of the fourth radiation conductor.

23. A monopole antenna comprising:

a dielectric substrate that erects from a ground surface; and a radiation conductor that is provided on a surface of the dielectric substrate, a bottom end of the radiation conductor being connected to a feeder line, the radiation conductor having a zigzagged band-shaped portion that extends in the vertical direction as a whole while its actual extension direction varies successively or continuously, wherein the radiation conductor has, as a top portion, a wide portion that is wider than the zigzagged band-shaped portion.

24. The monopole antenna according to claim 23, further comprising a second radiation conductor that extends parallel with a plane that is approximately perpendicular to the dielectric substrate, the second radiation conductor being connected to a top end of the radiation conductor.

25. The monopole antenna according to claim 24, further comprising a small dielectric substrate that is provided on the dielectric substrate so as to be approximately perpendicular to the dielectric substrate, wherein the second radiation conductor is provided on one or both surfaces of the small dielectric substrate.

* * * * *